US008375464B2

(12) United States Patent
Birmingham

(10) Patent No.: US 8,375,464 B2
(45) Date of Patent: Feb. 19, 2013

(54) ISOLATION GARMENT AND FOOTWEAR

(76) Inventor: McCann D. Birmingham, New Britain, CT (US)

( * ) Notice: Subject to any disclaimer, the term of this patent is extended or adjusted under 35 U.S.C. 154(b) by 0 days.

(21) Appl. No.: 13/224,984

(22) Filed: Sep. 2, 2011

(65) Prior Publication Data

US 2012/0227151 A1 Sep. 13, 2012

Related U.S. Application Data

(63) Continuation of application No. 13/043,881, filed on Mar. 9, 2011.

(51) Int. Cl.
*A41D 13/04* (2006.01)

(52) U.S. Cl. ..... 2/51

(58) Field of Classification Search ..... 2/51, 901, 2/456, 82, 114, 48, 52, 457, 83, 49.1, 74, 2/79, 46, 49.4, 50, 76, 85, 87, 104–106, 69, 2/115; D2/860, 861, 720, 739
See application file for complete search history.

(56) References Cited

U.S. PATENT DOCUMENTS

| | | | | | |
|---|---|---|---|---|---|
| 431,332 | A * | 7/1890 | Chadwick | 2/48 |
| 2,668,294 | A * | 2/1954 | Gilpin | 2/114 |
| 3,011,172 | A * | 12/1961 | Tames | 2/51 |
| 3,470,568 | A * | 10/1969 | Belkin | 2/114 |
| 3,921,221 | A * | 11/1975 | Zoephel | 2/51 |
| 4,304,006 | A * | 12/1981 | Swart | 2/49.1 |
| 4,951,318 | A * | 8/1990 | Harreld et al. | 2/48 |
| 5,142,704 | A * | 9/1992 | Viemeister et al. | 2/202 |
| 5,588,155 | A * | 12/1996 | Baker et al. | 2/123 |
| 6,851,125 | B2 * | 2/2005 | Fujikawa et al. | 2/51 |

* cited by examiner

*Primary Examiner* — Amy Vanatta
(74) *Attorney, Agent, or Firm* — Steven M. McHugh

(57) ABSTRACT

An isolation gown is provided and includes a body cover portion that is open near the knee area of the wearer. The gown includes two sleeves, wherein each of the sleeves is configured to cover a wearer's arm and terminate in an arm opening located proximate a wearer's wrist, such that each arm of the wearer is covered by the sleeves to an area proximate the wearer's wrist, wherein each of the arm openings includes a continuous elastic portion surrounding the arm opening to resiliently contact the wearer's arm, and a collar defining a neck opening, wherein the collar defines a collar opening and includes a configurable connecting article to close the collar opening, wherein each of the body cover portion and the two sleeves are constructed from a material impervious to liquids.

9 Claims, 4 Drawing Sheets

ISOLATION GARMENT AND FOOTWEAR

RELATED APPLICATIONS

This application is a continuation of co-pending application Ser. No. 13/043,881 filed Mar. 9, 2011 entitled "Isolation Garment and Footwear" and claims the benefit of the filing date of application Ser. No. 12/220,599 filed Jul. 25, 2008 and entitled "Isolation Garment and Footwear" now issued into U.S. Pat. No. 7,926,120, the contents of both of which are incorporated herein by reference in their entireties.

BACKGROUND OF THE INVENTION

Clothing and footwear that is impervious (or semi-impervious) to fluids in a health care setting are known, and are mainly used to protect employees that work in high risk areas of healthcare facilities (i.e. hospitals, emergency rooms, surgery) to protect against contact of blood, saliva, etc, with the skin of the worker. However, in areas that have a lesser risk of bodily fluid contamination, such as rehabilitation facilities, nursing homes and private nursing, the isolation gowns worn to protect health care workers from varying problematic situations still allow a portion of the liquids/fluids to penetrate through the fabric, thus exposing the workers and patients to cross-contamination and transmission risks (MRSA, etc). Additionally, these isolation gowns are not configured to protect the employees clothing and footwear from becoming wet while giving showers to patients (whether the patient is in a shower stretcher, shower chair, or even getting washed in bed).

SUMMARY OF THE INVENTION

An isolation gown for covering the body of a wearer is provided, where the isolation gown includes a body cover portion. The body cover portion is configured to cover the body of the wearer between an area proximate a neck area of the wearer and a knee area of the wearer, wherein the body cover portion is open near the knee area of the wearer. The isolation gown includes two sleeves, wherein each of the sleeves is configured to cover a wearer's arm and terminate in an arm opening located proximate a wearer's wrist, such that each arm of the wearer is covered by the sleeves to an area proximate the wearer's wrist, wherein each of the arm openings includes a continuous elastic portion surrounding the arm opening to resiliently contact the wearer's arm. The isolation gown includes a collar defining a neck opening, wherein the collar defines a collar opening and includes a configurable connecting article to close the collar opening, wherein each of the body cover portion and the two sleeves are constructed from a material impervious to liquids.

An isolation gown for covering the body of a wearer is provided, where the isolation gown includes a body cover portion configured to cover the body of the wearer between an area proximate a neck area of the wearer and a knee area of the wearer, wherein the body cover portion is open near the knee area of the wearer. The isolation gown further includes two sleeves, wherein each of the sleeves is configured to cover a wearer's arm and terminate in an arm opening located proximate a wearer's wrist, such that each arm of the wearer is covered by the sleeves to an area proximate the wearer's wrist, wherein each of the arm openings includes a continuous elastic portion surrounding the arm opening to resiliently contact the wearer's arm. The isolation gown also includes a collar defining a neck opening, wherein the collar further defines a collar opening and includes a first connecting device located on one side of the collar opening and a second connecting device located on the other side of the collar opening, wherein the first and second connecting devices are configurable to associate with each other to connect the first and second connecting devices together, wherein each of the body cover portion and the two sleeves are constructed from a material impervious to liquids.

BRIEF DESCRIPTION OF THE DRAWINGS

The foregoing and other features and advantages of the present invention will be more fully understood from the following detailed description of illustrative embodiments, taken in conjunction with the accompanying drawings in which like elements are numbered alike.

DETAILED DESCRIPTION OF THE INVENTION

Figure 1:
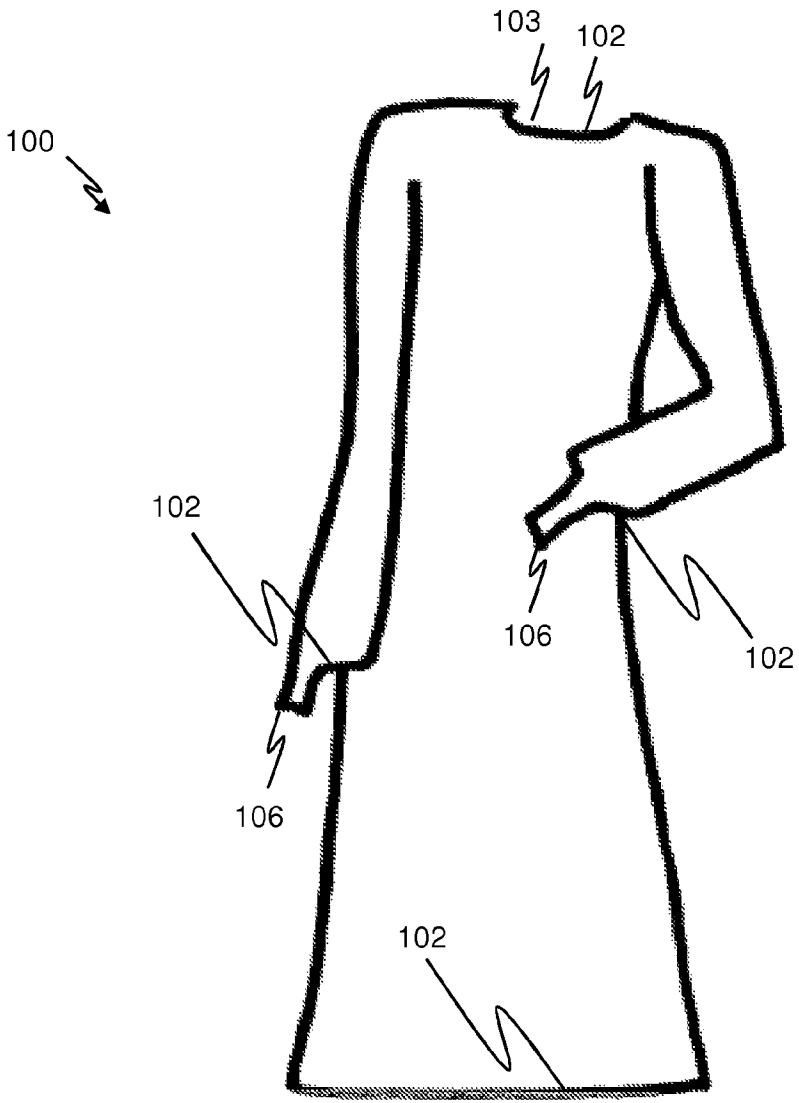
FIG. 1 illustrates a front view of an isolation gown, in accordance with the present invention.
Figure 2:
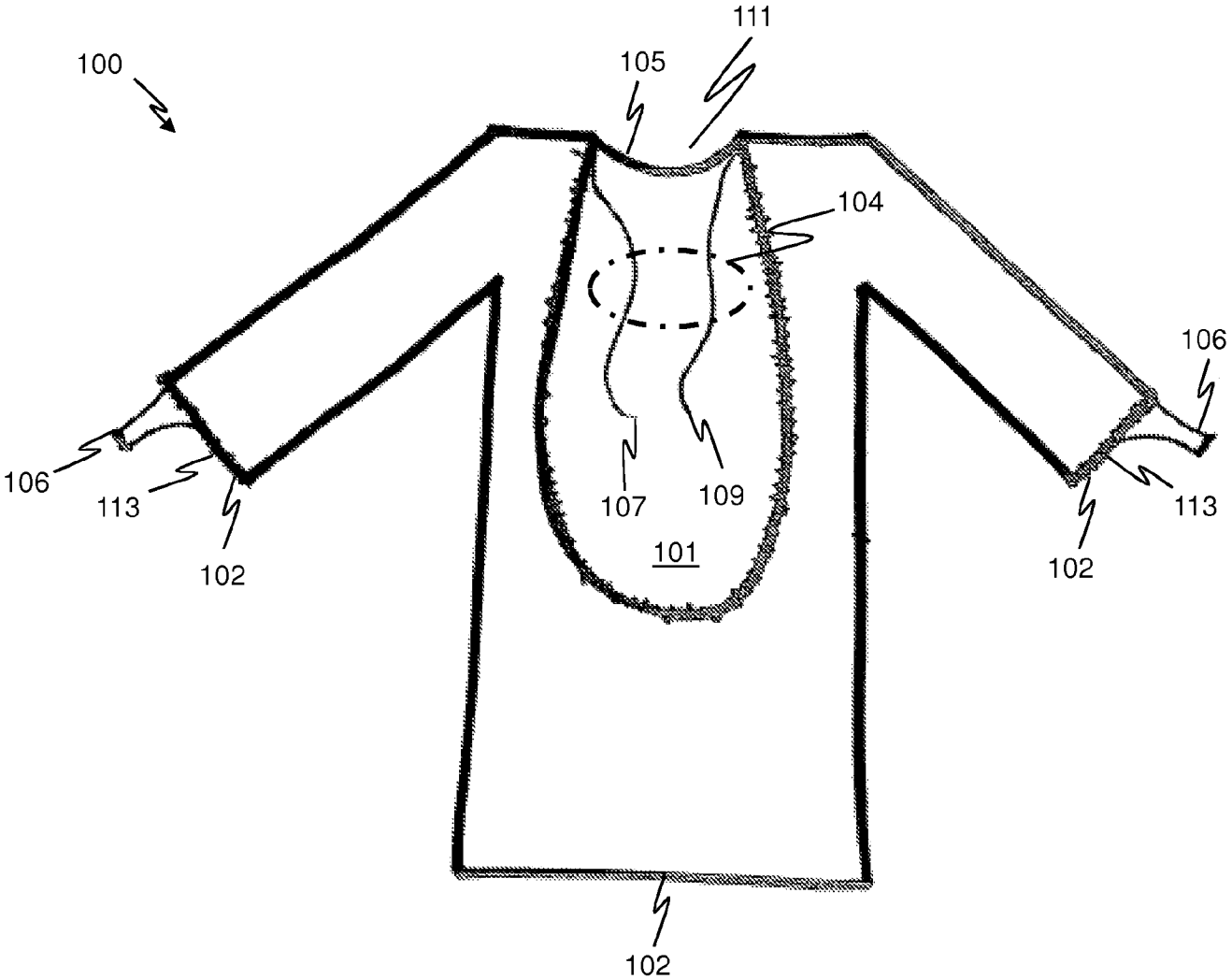
FIG. 2 illustrates a back view of the isolation gown of FIG. 1.

As disclosed herein with regards to an exemplary embodiment, an isolation gown 100 and isolation footwear 200 is described. Referring to FIG. 1 and FIG. 2, isolation gown 100 is shown and is a multifunctional gown that can be easily worn by health care workers, such as RN's and CNA's, to provide isolation from liquids and bodily fluids from patients during non-surgical hygienic procedures. As can be seen, isolation gown 100 includes a body cover portion that is configured to cover the majority of the wearer's body down to an area which is proximate to the knee portion or foot portion of the wearer. The isolation gown 100 includes sleeves and an open back portion 101 having a connecting portion 104 to allow the isolation gown 100 to be secured and to accommodate wearers of different sizes. The sleeves of the isolation gown 100 are configured to cover the majority of the arms and terminate proximate the wrist of the wearer such that gloves can cover the portion of the wearers hand and arm not covered by the isolation gown 100.

In accordance with one embodiment of the invention, as shown in FIG. 2 the isolation gown includes a neck opening 103 that is at least partially surrounded by a collar 105, where the collar includes a collar opening 111 proximate the back of the neck of the wearer. In one embodiment, the connecting article 104 is a tie device that includes a first tie device 107 and a second tie device 109 each of which start at the collar 105 of the isolation gown 100, where the first tie device 107 is located on one side of the collar opening 111 and the second tie device 109 is located on the other side of the collar opening 111. The location of the first tie device 107 and the second tie device 109 allow the sides of the collar opening 111 to be brought together to better secure and fit the wearer. This configuration allows the isolation gown 100 to fit a large variety of wearer sizes and work with gowns having different types of open back portions 102, such as gowns with half-open backs and/or full-open backs.

Isolation gown 100 is made of material that provides isolation from fluids, such as quality impervious materials provided by Du Pont and other manufacturers. Accordingly, the material used to construct isolation gown 100 may be flame resistant, waterproof, blood stain resistant, and proofed for accumulation of moisture. Isolation gown 100 includes several openings 102 (such as two arm openings 113) that have elastic borders for providing a secure fit to areas of the wearer to prevent or minimize intrusion of fluids while allowing for a full range of movement. Additionally, the isolation garment 100 also includes thumbhooks to prevent the sleeves from retracting away from the hand portion of the wearer, where the anchors 106 wrap around the respective hand of the wearer to cross the palm of the hand. Furthermore, the isolation gown 100 includes highly protective gathers on the garment that helps to further prevent the medical staff from becoming wet while giving showers while having a full range of movement. This will restore the confidence of the staff to proceed with giving their patients showers without having to perform the rest of their daily functions in wet clothing.

Furthermore, the isolation gown may be conveniently located and stored in individually wrapped packages for ease of use and the binding of this extraordinary fabric assists with common tasks such as dressing/undressing open wounds and uncontrollable bladders, while providing the isolation to prevent cross contamination. In accordance with the present invention, the isolation garment 100 may be constructed from several pieces of quality impervious materials or isolation garment 100 may be constructed from one piece of quality impervious material and may include gathers that are located in key areas throughout the garment to keep the key areas close to the body of the wearer, such as under the arms.

Figure 3:
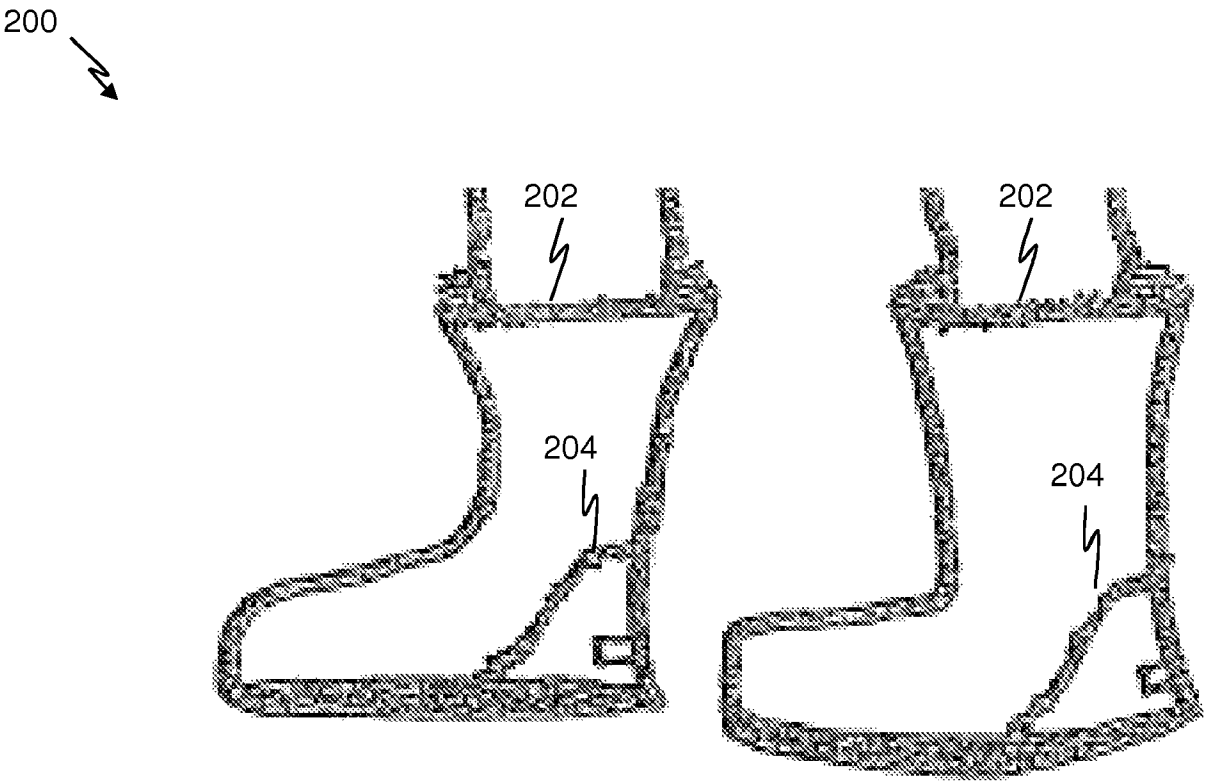
FIG. 3 illustrates a side view of isolation footwear, in accordance with the present invention.
Figure 4:
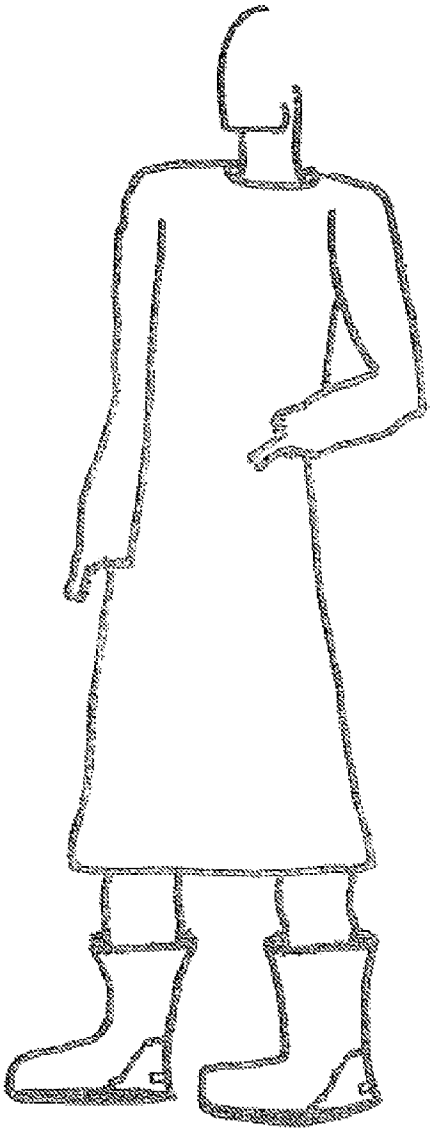
FIG. 4 illustrates a front view of a person wearing the isolation gown of FIG. 1 and the isolation footwear of FIG. 3, in accordance with the present invention.

Also provided is an isolation footwear 200, as shown in FIG. 3, wherein the isolation ware 200 is a multifunctional shoe cover which isolates a wearer's shoes from liquids and bodily fluids. Accordingly, similarly to the isolation gown 100, the material used to construct isolation footwear 200 may also be flame resistant, waterproof, blood stain resistant, and proofed for accumulation of moisture, where the isolation footwear 200 may be made of quality material provided by Du Pont or other manufacturer. As shown in FIG. 4, the isolation footwear 200 may be configured to cover a wearer's shoe and a portion of the wearer's leg and may include a leg opening 202 and a heel opening 204 to leave the heal of the wearer's shoe exposed for traction purposes. The heel opening 204 and the leg opening 202 of the isolation footwear 200 may include elastic borders to provide a seal from intrusion of liquids and bodily fluids. As such, a wearer simply slips their foot into the leg opening 202 until the isolation footwear 200 covers the wearer's shoe such that the heel of the wearer's shoe is exposed via the heel opening 204. The elastic portion of the isolation footwear 200 is then securely contacting the leg of the wearer and the heel of the wearer's shoe. Accordingly, the heel portion 202 of isolation footwear 200 provides effective protection from slips and falls and allows for free range of movement. Moreover, the isolation footwear 200 may be configured as one size fits all shoe sizes.

While the invention has been described with reference to an exemplary embodiment, it will be understood by those skilled in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiment(s) disclosed herein as the best mode contemplated for carrying out this invention.

I claim:

1. An isolation gown for covering a body of a wearer, the isolation gown comprising:

a body cover portion, where the body cover portion is configured to cover the body of the wearer between an area proximate a neck area of the wearer and a knee area of the wearer, wherein the body cover portion is open near the knee area of the wearer, two sleeves, wherein each of the sleeves is configured to cover a wearer's arm and terminate in an arm opening located proximate a wearer's wrist, such that each arm of the wearer is covered by the sleeves to an area proximate the wearer's wrist, wherein each of the arm openings includes a continuous elastic portion surrounding the arm opening to resiliently contact the wearer's arm, and a collar defining a neck opening, wherein the collar defines a collar opening and includes a configurable connecting article to close the collar opening, a back opening having a continuous elastic portion which traverses the back opening, wherein the back opening is associated with the neck opening via the collar opening, wherein each of the body cover portion and the two sleeves are constructed from a material impervious to liquids.

2. The isolation gown of claim 1, wherein the liquids include at least one of water and bodily fluids.

3. The isolation gown of claim 1, wherein further comprising a hand anchor means for preventing the sleeves from retracting away from a hand of the wearer.

4. The isolation gown of claim 3, wherein the hand anchor means is a thumbhook.

5. The isolation gown of claim 1, wherein the back opening is at least one of a half-back opening and a full-back opening.

6. The isolation gown of claim 1, wherein the connecting article includes a first connecting device located on one side of the collar opening and a second connecting device located on the other side of the collar opening, wherein the first and second connecting devices are configured to associate with each other to connect the first and second connecting devices.

7. The isolation gown of claim 6, wherein the first connecting device is a first tie device and the second connecting device is a second tie device, wherein the first tie device is located on one side of the collar opening and the second tie device is located on the other side of the collar opening to tyingly associate with each other.

8. An isolation gown for covering a body of a wearer, the isolation gown comprising:

a body cover portion, where the body cover portion is configured to cover the body of the wearer between an area proximate a neck area of the wearer and a knee area of the wearer, wherein the body cover portion is open near the knee area of the wearer, two sleeves, wherein each of the sleeves is configured to cover a wearer's arm and terminate in an arm opening located proximate a wearer's wrist, such that each arm of the wearer is covered by the sleeves to an area proximate the wearer's wrist, wherein each of the arm openings includes a continuous elastic portion surrounding the arm opening to resiliently contact the wearer's arm, and a collar defining a neck opening, wherein the collar defines a collar opening and includes a first connecting device located on one side of the collar opening and a second connecting device located on the other side of the collar opening, wherein the first and second connecting devices are configurable to associate with each other to connect the first and second connecting devices together, a back opening having a continuous elastic portion which traverses the back opening, wherein back opening is associated with the neck opening via the collar opening, wherein each of the body cover portion and the two sleeves are constructed from a material impervious to liquids.

9. The isolation gown of claim 8, wherein the first connecting device is a first tie device and the second connecting device is a second tie device, the first tie device being located on one side of the collar opening and the second tie device being located on the other side of the collar opening, the first and second tie device being configurable to tyingly associate with each other.

* * * * *